US011306380B2

(12) United States Patent
Gehrmann et al.

(10) Patent No.: US 11,306,380 B2
(45) Date of Patent: Apr. 19, 2022

(54) METHOD FOR PREPARING A NICKEL-BASED ALLOY

(71) Applicant: VDM Metals International GmbH, Werdohl (DE)

(72) Inventors: Bodo Gehrmann, Plettenberg (DE); Burkhard Erpenbeck, Boenen (DE)

(73) Assignee: VDM Metals International GmbH, Werdohl (DE)

( * ) Notice: Subject to any disclaimer, the term of this patent is extended or adjusted under 35 U.S.C. 154(b) by 200 days.

(21) Appl. No.: 16/757,810

(22) PCT Filed: Dec. 3, 2018

(86) PCT No.: PCT/DE2018/100980
§ 371 (c)(1),
(2) Date: Apr. 21, 2020

(87) PCT Pub. No.: WO2019/110050
PCT Pub. Date: Jun. 13, 2019

(65) Prior Publication Data

US 2021/0371963 A1 Dec. 2, 2021

(30) Foreign Application Priority Data

Dec. 4, 2017 (DE) ..... 10 2017 128 663.2
Nov. 29, 2018 (DE) ..... 10 2018 009 375.2

(51) Int. Cl.
*C22F 1/10* (2006.01)
*C22C 19/05* (2006.01)

(52) U.S. Cl.
CPC ..... *C22F 1/10* (2013.01); *C22C 19/056* (2013.01)

(58) Field of Classification Search
CPC ..... C22F 1/10; C22B 9/20; C22B 9/18; C22C 19/055; C22C 19/056; C22C 19/057; C22C 19/053
See application file for complete search history.

(56) References Cited

U.S. PATENT DOCUMENTS

| | | | |
|---|---|---|---|
| 6,416,564 | B1 | 7/2002 | Bond et al. |
| 9,765,416 | B2 | 9/2017 | Banik et al. |
| 2002/0170386 | A1 | 11/2002 | Bond et al. |
| 2009/0181299 | A1 | 7/2009 | Kato et al. |

FOREIGN PATENT DOCUMENTS

| | | | |
|---|---|---|---|
| CN | 1503850 | A | 6/2004 |
| CN | 104561664 | A | 4/2015 |
| DE | 10 2015 016 729 | A1 | 6/2017 |
| EP | 1 377 690 | B1 | 1/2008 |
| JP | 2004-527377 | A | 9/2004 |
| JP | 2009-170159 | A | 7/2009 |
| JP | 2018-525518 | A | 9/2018 |
| WO | 02/072897 | A1 | 9/2002 |
| WO | 2013/117529 | A1 | 8/2013 |
| WO | 2016/209591 | A1 | 12/2016 |

OTHER PUBLICATIONS

Alok Choudhury: "State of the Art of Superalloy Production for Aerospace and Other Application Using VIM/VAR or VIM/ESR", ISIJ International, Tokyo, JP, vol. 32, No. 5, 1992, pp. 563-574. (12 pages) (corrected citation).
English translation of the International Preliminary Report on Patentability and Written Opinion of the International Search Authority in PCT/DE2018/100980, dated Jun. 18, 2020.
International Search Report of PCT/DE2018/100980, dated Mar. 13, 2019.
Choudhury: "State of the Art of Superalloy Production for Aerospace and Other Application Using VIM/VAR or VIM/ESR", ISU International, Tokyo, JP, vol. 32, No. 5, 1992, pp. 563-574.

*Primary Examiner* — Jessee R Roe
(74) *Attorney, Agent, or Firm* — Collard & Roe, P.C.

(57) ABSTRACT

In a method for preparing a nickel-based alloy, an electrode is produced by VIM, VOF or VLF, heat-treated in a furnace between 500 and 1300° C. for 10 to 336 hours to reduce stresses and aging, the heat-treatment being conducted for at least 10 hours and at most 48 hours at 1000° C. to 1300° C., and cooled to between room temperature and less than 900° C., then remelted using ESR at 3.0 to 10 kg/minute to form an ESR block which is cooled to between room temperature and less than 900° C., and remelted again using VAR at 3.0 to 10 kg/minute and a remelting rate fluctuation range of less than 15%, preferably 10%, ideally 5%; the remelted VAR block is heat-treated between 500 and 1250° C. for 10 to 336 hours, then shaped into the desired product shape and dimension by hot or cold forming.

14 Claims, No Drawings

METHOD FOR PREPARING A NICKEL-BASED ALLOY

CROSS REFERENCE TO RELATED APPLICATIONS

This application is the National Stage of PCT/DE2018/100980 filed on Dec. 3, 2018, which claims priority under 35 U.S.C. § 119 of German Application Nos. 10 2017 128 663.2, filed on Dec. 4, 2017 and 10 2018 009 375.2, filed on Nov. 29, 2018, the disclosures of which are incorporated by reference. The international application under PCT article 21(2) was not published in English.

The invention relates to a method for the manufacture of a nickel-base alloy.

EP 1 377 690 B1 discloses a method for the manufacture of a nickel-base superalloy, which is substantially free of positive and negative segregation, wherein the method comprises the following:

Casting an alloy in a casting mold,

Annealing and over-aging the alloy by heating it to at least 649° C. for a duration of at least 10 hours, Electroslag remelting of the alloy at a melting rate of at least 3.63 kg/minute, Transferring the alloy into a heating oven within 4 hours after complete solidification, Holding the alloy in the heating oven at a first temperature of 316° C. to 982° C. for a duration of at least 10 hours, Raising the furnace temperature from the first to a second temperature of at least 1163° C., such that thermal stresses within the alloy are prevented, Holding the alloy at the second temperature for a period of at least 10 hours, Vacuum arc remelting of a VAR electrode of the alloy at a melting rate of 3.63 to 5 kg/minute in order to manufacture a VAR ingot.

The nickel-base alloy preferably relates to alloy 718 or alloy 706.

It is generally known that heat treatments in the higher temperature range (e.g. 500-1250° C.) may be used in order to homogenize segregations and to relieve stresses in the material.

The task of the invention is to provide an alternative, more inexpensive method for the manufacture of a nickel-base alloy, by means of which an improvement of the microstructure as well as a reduction of the defects introduced into the material during the last remelting step is possible, in order to do justice to future customer requirements. Compared with the method disclosed in EP 1 377 690 B1, costs incurred by complex process control between the first and the second remelting are to be avoided. And the quality is to be significantly improved by avoiding defects induced by melting and remelting.

This task is accomplished by a method for the manufacture of a nickel-base alloy in which an electrode is generated by VIM, VOD or VLF, for reduction of stresses and for over-aging, the electrode is subjected in a furnace to a heat treatment in the temperature range between 500 and 1300° C. for a period of 10 to 336 hours, wherein heat treatment is applied for at least 10 hours and at most 48 hours in the temperature range of 1000° C. to 1300° C.

the electrode is cooled in air or in the furnace to a temperature between room temperature and lower than 900° C., the cooled electrode is then remelted by ESR at a remelting rate of 3.0 to 10 kg/minute to obtain an ESR ingot, the ESR ingot is cooled in air or in the furnace to a temperature between room temperature and lower than 900° C., the ESR ingot is remelted again by means of VAR at a remelting rate of 3.0 to 10 kg/minute and a range of fluctuation of the remelting rate of smaller than 15%, better still 10%, ideally 5%, the remelted VAR ingot is subjected to a heat treatment in the temperature range between 500 and 1250° C. for a period of 10 to 336 hours, the VAR ingot is then brought by hot and/or cold working to the desired product shape and dimension.

Advantageous further developments of the method according to the invention (e.g. further steps of remelting by VAR) can be inferred from the dependent claims.

Compared with the prior art, the heat-treatment step following remelting by ESR is eliminated and the remelting rate is specified more precisely. Thus the heat treatment takes place exclusively on the basic electrode and not, as described in the prior art, on the ESR ingot. The material generated in this way has a much lower content of remelting-induced defects.

Due to the selective heat treatment of the VIM ingot, internal stresses are relieved and segregation defects are eliminated. This acts positively on the subsequent remelting steps of ESR and VAR.

This task is preferably also accomplished by a method for the manufacture of a nickel-base alloy in which an electrode is generated by VIM, if the Ni-base alloy forms a gamma prime phase: the electrode is introduced into a furnace before it becomes cooler than 200° C., ideally before it becomes cooler than 250° C.

for reduction of stresses and for over-aging, the electrode is subjected in a furnace to a heat treatment in the temperature range between 500 and 1250° C. for a period of 10 to 336 hours, the electrode is cooled in air or in the furnace to a temperature between room temperature and lower than 900° C., the surface of the electrode is machined for removal of defects and for cleaning it up (e.g. by brushing, grinding, pickling, cutting, scalping, etc.), the cooled electrode is then remelted by ESR at a remelting rate of 3.0 to 10 kg/minute to obtain an ESR ingot with a diameter of 400 to 1500 mm, the ESR ingot is cooled in air or in the furnace to a temperature between room temperature and lower than 900° C., if necessary, the surface of the ESR ingot is machined for removal of defects and for cleaning it up (e.g. by brushing, grinding, pickling, cutting, scalping, etc.), the cooled ESR ingot is subjected to a further heat treatment in the temperature range between 500 and 1250° C. for a period of 10 to 336 hours;

the ESR ingot is cooled in air or in the furnace to a temperature between room temperature and lower than 870° C., the ESR ingot is remelted again by means of VAR at a remelting rate of 3.0 to 10 kg/minute and a range of fluctuation of the remelting rate of smaller than 15%, better still 10%, ideally 5% to obtain a VAR ingot with a diameter of 400 to 1500 mm, if the Ni-base alloy forms a gamma prime phase: the VAR ingot is introduced into a furnace before it becomes cooler than 200° C. in the top region, ideally before this becomes cooler than 250° C., the remelted VAR ingot is subjected to a heat treatment in the temperature range between 500 and 1250° C. for a period of 10 to 336 hours, the VAR ingot is cooled in air or in the furnace to a temperature between room temperature and lower than 900° C. or, while still hotter than 850° C., is delivered to a hot-working process, the VAR ingot is then brought by hot and/or cold working (e.g. forging, rolling, drawing) to the desired product shape (e.g. ingot, bar, wire, sheet, strip, foil) and dimension.

It may be of advantage if the electrode is subjected prior to its first remelting to a machining of the surface (e.g. by brushing, grinding, pickling, cutting, scalping, etc.). In the process, defects may be removed that are not eliminated by the further remelting and that may cause impairment for subsequent applications.

According to a further idea of the invention, the ESR ingot is subjected prior to its VAR remelting to a further machining of the surface (e.g. by brushing, grinding, pickling, cutting, scalping, etc.), wherein it is also possible in the process to remove defects that cannot be eliminated by the further remelting.

According to a further idea of the invention, a remelting by VAR is performed directly instead of the remelting by ESR.

This method can be applied to any Ni alloy and in particular to alloys according to Table 1.

In the following, an alloy composition is presented that may be produced by means of the process parameters according to the invention. All values are in wt %:

| | |
|---|---|
| C | max. 0.25 |
| S | max. 0.03 |
| Cr | 17-32 |
| Ni | 33-72 |
| Mn | max. 1 |
| Si | max. 1 |
| Mo | 0-10 |
| Ti | max. 3.25 |
| Nb | max. 5.5 |
| Cu | max. 0.5 |
| Fe | max. 25 |
| Al | max. 3.15 |
| V | max. 0.6 |
| Zr | max. 0.12 |
| Co | max. 35 |

and manufacturing-related impurities.

As well as, optionally (values in wt %):

| | |
|---|---|
| Nb + Ta | max. 5.2 |
| B | max. 0.02 |
| Se | max. 0.0005 |
| Bi | max. 0.00005 |
| Pb | max. 0.002 |
| P | max. 0.03 |

Advantageously, the following elements may be adjusted as shown below (values in wt %):

| | |
|---|---|
| C | max. 0.2 |
| S | max. 0.02 |
| Cr | 17-25 |
| Ni | 45-58 |
| Mn | max. 0.6 |
| Si | max. 0.4 |

-continued

| | |
|---|---|
| Mo | 0-6.1 |
| Ti | 0.1-2.7 |
| Al | max. 1.7 |
| Co | max. 13 |

In the following, an example of an alloy on the basis of alloy 718 is presented (values in wt %):

| | |
|---|---|
| C | max. 0.08 |
| S | max. 0.015 |
| Cr | 17-21 |
| Ni | 50-55 |
| Mn | max. 0.35 |
| Si | max. 0.35 |
| Mo | 2.8-3.3 |
| Ti | 0.65-1.15 |
| Nb | 4.75-5.5 |
| Cu | max. 0.3 |
| Fe | 6-25 |
| P | max. 0.015 |
| Al | 0.2 to 0.8 |
| Co | max. 1 |
| B | max. 0.006 |
| Ta | max. 0.05 |
| Pb | max. 0.001 |
| Se | max. 0.0005 |
| Bi | max. 0.00005 |

Alternatively, this alloy may also have higher Ni contents.

| | |
|---|---|
| C | max. 0.1 |
| S | max. 0.03 |
| Cr | 17-32 |
| Ni | 58-79 |
| Nb | max. 0.6 |
| Fe | max. 18 |
| C | max. 0.1 |
| S | max. 0.02 |
| Cr | 17-30 |
| Ni | 58-72 |
| Mn | max. 1 |
| Si | max. 1 |
| Mo | 0-10 |
| Ti | max. 3.25 |
| Nb | max. 4.1 |
| Cu | max. 0.5 |
| Fe | max. 18 |
| Al | max. 3.15 |
| V | max. 0.6 |
| Zr | max. 0.1 |
| Co | max. 15 |

As well as, optionally (values in wt %):

| | |
|---|---|
| B | max. 0.008 |
| Se | max. 0.0005 |
| Bi | max. 0.00005 |
| Pb | max. 0.002 |
| P | max. 0.03 |

Further restrictions are conceivable such as below (values in wt %):

| | |
|---|---|
| C | 0.01-0.04 |
| Mn | max. 0.5 |
| Si | max. 0.5 |
| Cu | max. 0.2 |

As well as, optionally if necessary (values in wt %):

Mo 8-10

In the following, an example of an alloy on the basis of alloy 780 is presented (values in wt %):

| | |
|---|---|
| C | max. 0.1 |
| S | max. 0.015 |
| N | max. 0.03 |
| Cr | 16-20 |
| Ni | 26-62 |
| Mn | max. 0.5 |
| Si | max. 0.3 |
| Mo | 2-4 |
| Ti | 0.1-1 |
| Cu | max. 0.5 |
| Fe | max. 10 |
| P | max. 0.03 |
| Al | 1 to 3 |
| Mg | max. 0.01 |
| Ca | max. 0.01 |
| Zr | max. 0.05 |
| Co | 15-28 |
| B | max. 0.02 |
| O | max. 0.02 |
| Nb + Ta | 4-6 |

Material manufactured by this fabrication process usually has significantly fewer defects (50%) having comparison defect size of 0.8 mm in an ultrasonic inspection.

The method according to the invention is intended to be usable preferably for the following alloys:

Alloy 601
Alloy 602 CA and its variant MCA
Alloy 617 and its variants 617 B and 617 OCC
Alloy 625
Alloy 690
Alloy 699XA
Alloy 718 and its variants
Alloy 780
Alloy 788
Alloy 80A
Alloy 81
Alloy X-750
Alloy C-263
Alloy K-500
Waspaloy
FM 625
FM 617 as well as
FM 602

As examples, Table 1 shows ranges of analysis of the aforementioned alloys.

Ingot formats >400 mm (round and polygonal) are achieved.

The VIM, ESR and VAR ingots may also be forged to electrode dimension, in order to create better homogeneity, as may be necessary depending on alloy and ingot diameter.

The hot forming to the required product shape and dimension may be carried out by the usual methods (forging, rolling, etc.).

The ingots and bars fabricated according to this method may be further fabricated to semi-finished product forms (bars, sheets, strips, foils, wires, etc.) with conventional methods.

By way of example, the method according to the invention is explained as follows:

Several heats, e.g. S3 and S4, were fabricated with the method according to the invention.

The electrodes were produced by VIM.

For reduction of stresses and for equilibration of segregations, the electrodes were heat-treated in a furnace in the temperature range between 500 and 1300° C. for a period of 10 to 72 hours. In the process, heat treatment was applied for at least 10 hours and at most 48 hours in the temperature range of 1000° C. to 1300° C.

The electrodes were cooled in air or in the furnace to a temperature between room temperature and lower than 900° C.

The electrodes were subjected to surface treatments such as grinding, etc.

The electrodes were then remelted by ESR at a remelting rate of 3 to 6 kg/minute to obtain an ESR ingot.

The ESR ingots were cooled in the furnace to a temperature between room temperature and lower than 900° C., The ESR ingots were remelted by means of VAR at a remelting rate of 3 to 6 kg/minute.

Thereupon the VAR ingots were heat-treated in a furnace in the temperature range between 500 and 1220° C. for a period of 20 to 100 hours.

The VAR ingots were then ground or, in unmachined condition, were processed by hot or cold working to bars.

In the comparison heats S1 and S2, which were not subjected to the method according to the invention, the electrodes produced by VIM were heat-treated, for reduction of stresses and for equilibration of segregations, only in a furnace in the temperature range between 500 and 1000° C. for a period of 10 to 48 hours.

All heats (both those according to the invention and the comparison heats) were fabricated according to the analysis reports of alloy 718 (see Table 1).

The deviations from the chosen remelting rates that occurred during fabrication are shown in Table 2.

Deviations of the remelting rate occurred up to the following levels.

TABLE 2

| | S1 (414972) | S2 (415078) | S3 (415130) | S4 (415156) |
|---|---|---|---|---|
| Deviation above | +26.39% | +43.89% | +2.2 | +2.2 |
| Deviation below | −40.83% | −46.67% | −0.83 | −0.56 |

TABLE 1

| Mass % | VDM alloy 601 Alloy 601 min-max | VDM alloy 602 CA/MCA Alloy 602 CA/MCA min-max | VDM FM 602 FM 602 min-max | VDM alloy 617 (B/OCC) Alloy 617 (B/OCC) min-max | VDM FM 617 FM 617 min-max | VDM alloy 625 Alloy 625 min-max |
|---|---|---|---|---|---|---|
| C | 0.03-0.1 | 0.15-0.25 | 0.15-0.25 | 0.05-0.08 | 0.05-0.15 | −0.03 |
| S | −0.015 | −0.01 | | −0.008 | | −0.01 |
| N | | | | | | |

TABLE 1-continued

| | | | | | | |
|---|---|---|---|---|---|---|
| Cr | 21-25 | 24-26 | 24-26 | 21-23 | 20-24 | 21-23 |
| Ni | 58-63 | 59-66 | 59-66 | 45-58 | 50-61 | 58-71 |
| Mn | −1 | −0.5 | −0.5 | −0.5 | −1 | −0.5 |
| Si | −0.5 | −0.5 | −0.5 | −0.3 | −1 | −0.4 |
| Mo | | | | 8-10 | 8-10 | 8-10 |
| Ti | −0.5 | 0.1-0.2 | 0.1-0.2 | 0.25-0.5 | −0.6 | −0.4 |
| Nb | | | | −0.6 | | |
| Cu | −0.5 | −0.1 | −0.1 | | −0.5 | |
| Fe | −18 | 8-11 | 8-11 | −1.5 | −3 | −5 |
| P | −0.02 | −0.02 | | −0.012 | −0.03 | −0.01 |
| Al | 1-1.7 | 1.8-2.4 | 1.8-2.4 | 0.8-1.3 | 0.8-1.5 | −0.4 |
| Mg | | | | | | |
| Ca | | | | | | |
| Rare earths | | | | | | |
| V | | | | −0.6 | | |
| Zr | | 0.01-0.1 | 0.01-0.1 | | | |
| W | | | | | −0.5 | |
| Co | | | −1 | 11-13 | 10-15 | −1 |
| Y | | | 0.05-0.12 | | | |
| La | | | | | | |
| B | −0.006 | | | 0.001-0.005 | | |
| Hf | | | | | | |
| Ta | | | | | | |
| Ce | | | | | | |
| O | | | | | | |
| Pb | | | | | | |
| Sn | | | | | | |
| Zn | | | | | | |
| Se | | | | | | |
| Bi | | | | | | |
| Sb | | | | | | |
| Cd | | | | | | |
| Hg | | | | | | |
| H | | | | | | |
| As | | | | | | |
| Nb + Ta | | | 3.2-3.8 | | | 3.2-3.8 |

| Mass % | VDM FM 625 FM 625 min-max | VDM alloy 690 Alloy 690 min-max | VDM alloy 699XA Alloy 699XA min-max | VDM alloy 718 Alloy 718 min-max | VDM alloy 718 CTP Alloy 718 CTP min-max | VDM FM 718 FM 718 min-max |
|---|---|---|---|---|---|---|
| C | −0.1 | −0.05 | 0.005-0.12 | −0.08 | −0.045 | −0.08 |
| S | | −0.015 | −0.01 | −0.015 | −0.01 | |
| N | | | −0.05 | | | |
| Cr | 20-23 | 27-31 | 26-30 | 17-21 | 17-21 | 17-21 |
| Ni | 58-71 | 58-66 | 62-72 | 50-55 | 50-55 | 50-55 |
| Mn | −0.5 | −0.5 | −0.5 | −0.35 | −0.35 | −0.3 |
| Si | −0.5 | −0.5 | −0.5 | −0.35 | −0.35 | −0.3 |
| Mo | 8-10 | | | 2.8-3.3 | 2.8-3.3 | 2.8-3.3 |
| Ti | −0.4 | | −0.6 | 0.65-1.15 | 0.8-1.15 | 0.7-1.1 |
| Nb | 3-4.1 | | −0.5 | 4.75-5.5 | Nb + Ta | 4.8-5.5 |
| Cu | −0.5 | −0.5 | −0.5 | −0.3 | −0.23 | −0.3 |
| Fe | −5 | 7-11 | −2.5 | 6-25 | 12-24 | −24 |
| P | | | −0.02 | −0.015 | −0.01 | −0.015 |
| Al | −0.4 | | 2-3 | 0.2-0.8 | 0.4-0.6 | 0.2-0.8 |
| Mg | | | | | | |
| Ca | | | | | | |
| Rare earths | | | | | | |
| V | | | | | | |
| Zr | | | −0.1 | | | |
| W | | | | | | |
| Co | | | | −1 | −1 | |
| Y | | | | | | |
| La | | | | | | |
| B | | | −0.008 | −0.006 | −0.006 | −0.006 |
| Hf | | | | | | |
| Ta | | | | −0.05 | | |
| Ce | | | | | | |
| O | | | | | | |
| Pb | | | | −0.0005 | −0.001 | |
| Sn | | | | | | |
| Zn | | | | | | |

TABLE 1-continued

| | | | | | | |
|---|---|---|---|---|---|---|
| Se | | | | −0.0003 | −0.0005 | |
| Bi | | | | −0.00003 | −0.00005 | |
| Sb | | | | | | |
| Cd | | | | | | |
| Hg | | | | | | |
| H | | | | | | |
| As | | | | | | |
| Nb + Ta | 3.2-3.8 | | | | 4.87-5.2 | |

| Mass % | VDM alloy 780 Alloy 780 min-max | VDM alloy 788 Alloy 788 min-max | Waspaloy Waspaloy N07001 2.4654 min-max | VDM alloy C-263 Alloy C-263 min-max | VDM alloy 80A Alloy 80A min-max | VDM alloy 81 Alloy 81 min-max |
|---|---|---|---|---|---|---|
| C | −0.1 | 0.04-0.1 | 0.02-0.1 | 0.04-0.08 | 0.04-0.1 | −0.08 |
| S | −0.015 | −0.01 | −0.03 | −0.007 | −0.015 | −0.02 |
| N | −0.03 | | | | | |
| Cr | 16-20 | 18-21 | 18-21 | 19-21 | 18-21 | 28-32 |
| Ni | 26-62 | 51-69 | 49.6-62.5 | 50-55 | 65-79 | 59-66 |
| Mn | −0.5 | −1 | −1 | −0.6 | −1 | −0.7 |
| Si | −0.3 | −0.5 | −0.75 | −0.4 | −1 | −0.7 |
| Mo | 2-4 | | 3.5-5 | 5.6-6.1 | | −0.5 |
| Ti | 0.1-1 | 1.8-2.7 | 2.75-3.25 | 1.9-2.4 | 1.8-2.7 | 1.5-2.1 |
| Nb | | | | | | |
| Cu | −0.5 | −0.2 | −0.5 | −0.2 | −0.2 | −0.25 |
| Fe | −10 | 8-15 | −2 | −0.7 | −1.5 | −1.5 |
| P | −0.03 | −0.02 | −0.03 | −0.015 | | |
| Al | 1-3 | 1-1.8 | 1.2-1.6 | 0.3-0.6 | 1-1.8 | −1.2 |
| Mg | −0.01 | | | | | −1 |
| Ca | −0.01 | | | | | |
| Rare earths | | | | | | |
| V | | | | | | |
| Zr | −0.05 | | 0.02-0.12 | | | 0.01-0.1 |
| W | | | | | | |
| Co | 15-28 | 3-7 | 12-15 | 19-21 | | 01 March |
| Y | | | | | | |
| La | | | | | | |
| B | −0.02 | −0.008 | 0.003-0.01 | −0.005 | | −0.006 |
| Hf | | | | | | |
| Ta | | | | | | |
| Ce | | | | | | |
| O | −0.02 | | | | | |
| Pb | | | | −0.002 | | |
| Sn | | | | | | |
| Zn | | | | | | |
| Se | | | | | | |
| Bi | | | | | | |
| Sb | | | | | | |
| Cd | | | | | | |
| Hg | | | | | | |
| H | | | | | | |
| As | | | | | | |
| Nb + Ta | 4-6 | | | | | |

| Mass % | VDM alloy K-500 Alloy K-500 min-max | Alloy X-750 Alloy X-750 N07750 2.4669 min-max |
|---|---|---|
| C | −0.18 | −0.08 |
| S | −0.01 | −0.01 |
| N | | |
| Cr | | 14-17 |
| Ni | 63-70 | 70-77.5 |
| Mn | −1.5 | −1 |
| Si | −0.5 | −0.5 |
| Mo | | |
| Ti | 0.35-0.85 | 2.25-2.75 |
| Nb | | 0.7-1.2 |
| Cu | 27-33 | −0.5 |
| Fe | 0.5-2 | 5-9 |
| P | −0.02 | |
| Al | 2.3-3.15 | 0.4-1 |
| Mg | | |
| Ca | | |

TABLE 1-continued

| Rare earths | | |
|---|---|---|
| V | | |
| Zr | | |
| W | | |
| Co | | −1 |
| Y | | |
| La | | |
| B | | |
| Hf | | |
| Ta | | |
| Ce | | |
| O | | |
| Pb | −0.006 | |
| Sn | −0.006 | |
| Zn | −0.02 | |
| Se | | |
| Bi | | |
| Sb | | |
| Cd | | |
| Hg | | |
| H | | |
| As | | |
| Nb + Ta | | 0.7-1.2 |

EXPLANATIONS OF TERMS

VIM Vacuum Induction Melting

VOD Vacuum Oxygen Decarburization

VLF Vacuum Ladle Furnace

ESR Electroslag Remelting

The invention claimed is:

1. A method for the manufacture of a nickel-base alloy, in which an electrode is produced by VIM, VOD or VLF, for reduction of stresses and for over-aging, the electrode is subjected in a furnace to a heat treatment in the temperature range between 500 and 1300° C. for a period of 10 to 336 hours, wherein heat treatment is applied for at least 10 hours and at most 48 hours in the temperature range of 1000° C. to 1300° C.

the electrode is cooled in air or in the furnace to a temperature between room temperature and lower than 900° C., the cooled electrode is then remelted by ESR at a remelting rate of 3.0 to 10 kg/minute to obtain an ESR ingot, the ESR ingot is cooled in air or in the furnace to a temperature between room temperature and lower than 900° C., the ESR ingot is remelted again by means of VAR at a remelting rate of 3.0 to 10 kg/minute and a range of fluctuation of the remelting rate of smaller than 15%, the remelted VAR ingot is subjected to a heat treatment in the temperature range between 500 and 1250° C. for a period of 10 to 336 hours, and the VAR ingot is then brought by hot and/or cold working to the desired product shape and dimension.

2. The method according to claim 1, wherein, prior to its remelting by ESR, the electrode is subjected to a surface treatment.

3. The method according to claim 1, wherein, prior to its remelting by VAR, the ESR ingot is subjected to a surface machining.

4. A method for the manufacture of a nickel-base alloy, in which an electrode is generated by VIM, if the Ni-base alloy forms a gamma prime phase: the electrode is introduced into a furnace before the electrode becomes cooler than 200° C., for reduction of stresses and for over-aging, the electrode is subjected in a furnace to a heat treatment in the temperature range between 500 and 1250° C. for a period of 10 to 336 hours, the electrode is cooled in air or in the furnace to a temperature between room temperature and lower than 900° C., the surface of the electrode is machined for removal of defects and is cleaned, the cooled electrode is then remelted by ESR at a remelting rate of 3.0 to 10 kg/minute to obtain an ESR ingot with a diameter of 400 to 1500 mm, the ESR ingot is cooled in air or in the furnace to a temperature between room temperature and lower than 900° C., if necessary, the surface of the ESR ingot is machined for removal of defects and is cleaned, the cooled ESR ingot is subjected to a further heat treatment in the temperature range between 500 and 1250° C. for a period of 10 to 336 hours;

the ESR ingot is cooled in air or in the furnace to a temperature between room temperature and lower than 870° C., the ESR ingot is remelted again by means of VAR at a remelting rate of 3.0 to 10 kg/minute and a range of fluctuation of the remelting rate of smaller than 15% to obtain a VAR ingot with a diameter of 400 to 1500 mm, if the Ni-base alloy forms a gamma prime phase: the VAR ingot is introduced into a furnace before it the VAR ingot becomes cooler than 200° C. in the top region, the remelted VAR ingot is subjected to a heat treatment in the temperature range between 500 and 1250° C. for a period of 10 to 336 hours, the VAR ingot is cooled in air or in the furnace to a temperature between room temperature and lower than 900° C., or while still hotter than 850° C. is delivered to a hot-working process, and the VAR ingot is then brought by hot and/or cold working to the desired product shape and dimension.

5. The method according to claim 1, wherein the VAR ingot is remelted in further steps of remelting by VAR at a remelting rate of 3.0 to 10 kg/minute and is then subjected to a heat treatment in the temperature range between 500 and 1300° C. for a period of 10 to 336 hours.

6. The method according to claim 1, wherein, after the last heat treatment, the VAR ingot is cooled in air or in the furnace to a temperature between room temperature and lower than 900° C.

7. The method according to claim 1, wherein, after the last heat treatment, the VAR ingot is delivered while still hot to a hot working at a temperature of higher than 800° C.

8. The method according to claim 1, wherein an alloy of the following composition (in wt %) is used:

| | |
|---|---|
| C | max. 0.25% |
| S | max. 0.03% |
| Cr | 17-32% |
| Ni | 33-72% |
| Mn | max 1% |
| Si | max. 1% |
| Mo | 0 to 10% |
| Ti | up to 3.25% |
| Nb | up to 5.5% |
| Cu | up to 0.5% |
| Fe | up to 25% |
| P | max. 0.03% |
| Al | up to 3.15% |
| V | max. 0.6% |
| Zr | max. 0.1% |
| Co | up to 35% |
| B | max. 0.02% |

and manufacturing-related impurities.

9. The method according to claim 1, wherein an alloy of the following composition (in wt %) is used:

| | |
|---|---|
| C | max. 0.08 |
| S | max. 0.015 |
| Cr | 17-21 |
| Ni | 50-55 |
| Mn | max. 0.35 |
| Si | max. 0.35 |
| Mo | 2.8-3.3 |
| Ti | 0.65-1.15 |
| Nb | 4.75-5.5 |
| Cu | max. 0.3 |

-continued

| | |
|---|---|
| Fe | 6-25 |
| P | max. 0.015 |
| Al | 0.2 to 0.8 |
| Co | max. 1 |
| B | max. 0.006 |
| Pb | max. 0.001 |
| Se | max. 0.0005 |
| Bi | max. 0.00005 |
| Nb + Ta | 4.75 to 5.5% |

and manufacturing-related impurities.

10. The method according to claim 1, wherein an alloy of the following composition (in wt %) is used:

| | |
|---|---|
| C | max. 0.1 |
| S | max. 0.015 |
| N | max. 0.03 |
| Cr | 16-20 |
| Ni | 26-62 |
| Mn | max. 0.5 |
| Si | max. 0.3 |
| Mo | 2-4 |
| Ti | 0.1-1 |
| Cu | max. 0.5 |
| Fe | max. 10 |
| P | max. 0.03 |
| Al | 1 to 3 |
| Mg | max. 0.01 |
| Ca | max. 0.01 |
| Zr | max. 0.05 |
| Co | 15-28 |
| B | max. 0.02 |
| O | max. 0.02 |
| Nb + Ta | 4-6 |

and manufacturing-related impurities.

11. The method according to claim 1, wherein the diameter of the produced VAR ingot is >450 mm.

12. The method according to claim 1, wherein the diameter of the produced VAR ingot is >500 mm.

13. The method according to claim 1, wherein the produced ingot is free of remelting defects and in the ultrasonic inspection has a comparison defect size of <0.8 mm.

14. The method according to claim 1, in which the heat treatment of the VIM ingot was applied for at least 10 hours and at most 48 hours in the temperature range of 1000° C. to 1300° C.

* * * * *